US011596270B1

(12) United States Patent
Kaplan et al.

(10) Patent No.: US 11,596,270 B1
(45) Date of Patent: Mar. 7, 2023

(54) APPARATUS AND METHOD FOR DISPENSING HAND SANITIZER

(71) Applicant: MICOBRA LLC, Northbrook, IL (US)

(72) Inventors: Lawrence M. Kaplan, Northbrook, IL (US); Christopher D. Wagner, Bozeman, MT (US)

(73) Assignee: MICOBRA LLC

( * ) Notice: Subject to any disclaimer, the term of this patent is extended or adjusted under 35 U.S.C. 154(b) by 0 days.

(21) Appl. No.: 17/308,607

(22) Filed: May 5, 2021

(51) Int. Cl.
*A47K 5/12* (2006.01)

(52) U.S. Cl.
CPC ..... *A47K 5/1202* (2013.01); *A47K 5/1217* (2013.01)

(58) Field of Classification Search
CPC ..... A47K 5/1202; A47K 5/1217; B60N 3/105
See application file for complete search history.

(56) References Cited

U.S. PATENT DOCUMENTS

| | | | | |
|---|---|---|---|---|
| 7,782,214 | B1 * | 8/2010 | Lynn | A47K 5/1217 340/572.1 |
| D869,193 | S | 12/2019 | Peterson | |
| 10,499,774 | B1 * | 12/2019 | Ryan | A47K 5/1205 |
| 11,083,346 | B1 * | 8/2021 | Krenke | A47K 5/1202 |
| 2001/0035429 | A1 * | 11/2001 | Colquhoun | A47K 5/12 222/93 |
| 2005/0218159 | A1 * | 10/2005 | Hoour | B65D 77/0486 222/321.7 |
| 2008/0078773 | A1 * | 4/2008 | Cassese | B65D 81/3446 220/737 |
| 2008/0185398 | A1 * | 8/2008 | Yang | A47K 5/1217 222/52 |
| 2008/0185399 | A1 * | 8/2008 | Yang | A47K 5/1217 222/52 |
| 2008/0223880 | A1 * | 9/2008 | Pham | B65D 51/249 222/321.7 |
| 2012/0168466 | A1 * | 7/2012 | Mills | B05B 11/3001 222/321.7 |
| 2013/0098941 | A1 * | 4/2013 | Wegelin | A47K 5/1217 222/23 |
| 2014/0263426 | A1 * | 9/2014 | Gasper | B05B 12/085 222/65 |
| 2016/0288151 | A1 * | 10/2016 | Schultz | F16B 5/0657 |

(Continued)

FOREIGN PATENT DOCUMENTS

| | | | | |
|---|---|---|---|---|
| CA | 2157633 C | * | 12/1999 | B60N 3/103 |
| CN | 102176850 A | * | 9/2011 | A47J 27/004 |

(Continued)

OTHER PUBLICATIONS

CupFone with Hand Sanitizer Holder, Weathertech, https://www.weathertech.com/weathertech-cupfone/cupfone-with-hand-sanitizer-holder/, last accessed on May 24, 2021.

(Continued)

*Primary Examiner* — Bob Zadeh

(57) ABSTRACT

Apparatus and method for dispensing hand sanitizer and particularly for dispensing hand sanitizer in a car, truck or other vehicle. The apparatus is configured to be located and used in a vehicle's cup holder or mounted against a substantially vertical surface such as the rear or side of a vehicle seat or headrest. The apparatus includes one or more sensors to help provide consistent dose sizes and to prevent unwanted or improper usage under various operating conditions.

5 Claims, 11 Drawing Sheets

(56) References Cited

U.S. PATENT DOCUMENTS

| | | | | |
|---|---|---|---|---|
| 2016/0303598 | A1* | 10/2016 | Rifkin | B05B 9/002 |
| 2017/0254055 | A1* | 9/2017 | Xia | B08B 3/12 |
| 2018/0080807 | A1* | 3/2018 | Singh | A47K 5/1217 |
| 2020/0404405 | A1* | 12/2020 | Hunt | G06F 3/165 |

FOREIGN PATENT DOCUMENTS

| | | | | |
|---|---|---|---|---|
| CN | 201996312 | U * | 10/2011 | |
| EP | 3770564 | A1 * | 1/2021 | A47K 5/1217 |

OTHER PUBLICATIONS

Dropi—The Ultimate Solution to Clean Hands, Indiegogo, 2020, https://www.indiegogo.com/projects/dropi-the-ultimate-solution-to-clean-hands#/.

Foam Senser Pump, Simplehuman, https://www.simplehuman.com/products/foam-sensor-pump, last accessed on May 5, 2021.

Liquid Sensor Pump Max, Simplehuman, https://www.simplehuman.com/products/liquid-sensor-pump-max, last accessed May 5, 2021.

Liquid Sensor Pump, Simplehuman, https://www.simplehuman.com/products/battery-sensor-pump-8-fl-oz, last accessed on May 5, 2021.

Lisa Bassett, Indispensible™, MBHD Enterprises LLC, Sep. 8, 2014, http://mbhdllc.com/shop/indispensible-almond/.

Luxfill Hand Sanitizer Dispenser, https://www.amazon.com/Automatic-Sanitizer-Dispenser-Touchless-Sterilizer/dp/B089S7VL2F/ref=sr_1_6?dchild=1&keywords=luxfill+hand+sanitizer+dispenser+touchless&qid=1621879826&sr=8-6, Amazon, last accessed May 24, 2021.

Otto Foaming Automatic Soap Dispenser, Umbra, https://www.umbra.com/products/otto-foaming-soap-pump, last accessed May 24, 2021.

Rechargeable Liquid Sensor Pump, Simplehuman, https://www.simplehuman.com/products/rechargeable-sensor-pump-9-fl-oz, last accessed May 5, 2021.

Sativa Turner, Joey Soap Pump and Scrubby, Umbra, https://www.umbra.com/collections/soap-dispensers/products/joey-soap-pump-and-scrubby, last accessed on May 24, 2021.

Hand Sanitizer Dispenser by Halmo, Downloaded on Oct. 27, 2021, https://www.halmosculpture.com/pages/carhandgel/?utm_source=GadgetFlow&utm_medium=GadgetFlow&utm_campaign=GadgetFlow.

* cited by examiner

Double D-Shaped Geometry

D-Shaped Geometry

APPARATUS AND METHOD FOR DISPENSING HAND SANITIZER

FIELD OF THE DISCLOSURE

The present disclosure generally relates to apparatuses and methods for dispensing hand sanitizer and, more specifically, the present disclosure relates to apparatuses and methods for dispensing hand sanitizer within vehicles such as cars and trucks.

BACKGROUND OF THE DISCLOSURE

There are a number of hand sanitizer dispenser devices. Typically they use pumps to dispense hand sanitizer from a reservoir to the hands of a human user. Some dispenser devices use pumps activated by mechanical action of human users. Some dispenser devices use pumps powered by electricity, including batteries. Some electrically powered pumps are activated when the user presses a button. Some electrically powered pumps are "touchless" and are activated when the user passes his or her hand in the line of sight of a motion sensor included in the dispenser device.

Many of these hand sanitizer dispenser devices are designed to rest on a countertop, such as, for example, a bathroom or kitchen countertop, a desk, or other horizontal surface. Some hand sanitizer dispenser devices are designed to be mounted on a floor stand or on a vertical surface, such as a wall in a bathroom, airport, restaurant or other location.

Typically, these dispenser devices are intended for use inside of climate-controlled structures or, if in non-climate controlled structures or outdoors, then in climates where the temperatures are neither too hot nor too cold.

People sometimes use such hand sanitizer dispenser devices in their vehicles, such as cars and trucks, even though they were designed for use in non-vehicle locations, such as on countertops. Oftentimes, in the vehicle, such devices are not situated in a stable location, are difficult to use, are subjected to extreme hot or cold temperatures, and/or can be distracting to a driver.

An object of the inventions disclosed herein is to make it easier, more convenient, cleaner and safer for both drivers and passengers in a vehicle to use a hand sanitizer dispenser device in a vehicle. A further object of the inventions disclosed herein is provide a hand sanitizer dispenser device that rests or mounts in a stable way in a vehicle. An even further object of the inventions disclosed herein is to provide a hand sanitizer dispenser device that can be located in a convenient place for a driver, a front seat passenger, or one or more back seat passengers. Yet an even further object of the inventions disclosed herein is to provide a hand sanitizer device that works properly and consistently in both hotter and colder temperatures. Yet a still further object of the inventions disclosed herein is to provide a hand sanitizer dispenser device that minimizes driver distraction.

SUMMARY OF THE DISCLOSURE

An apparatus and method for dispensing hand sanitizer, soap or other personal cleaning liquid including water is disclosed. The device includes a reservoir for holding hand sanitizer liquid, a pump, a valve, and one or more tubes or hoses for the hand sanitizer to flow from the reservoir to the pump and from the pump to the valve. The device also includes a power source for operating the pump and a motion sensor for detecting a user's hand thereby activating the electrically-powered pump. The power source may be one or more batteries, or may be externally-supplied power. The device may also include one or both of a voltage sensor, temperature sensor and heater. As explained more fully herein, the voltage sensor, temperature sensor and heater help to provide that a relatively consistent amount of hand sanitizer is dispensed regardless of reductions in voltage supplied from a battery power source or changes in the environment, including the temperature in which the device is operating. The device is configured to both rest stably in a vehicle cup holder and mount on the rear or side of a front seat or headrest of a vehicle.

BRIEF DESCRIPTION OF THE FIGURES

For a fuller understanding of the nature and objects of the invention, reference should be made to the following detailed description taken in conjunction with the accompanying figures.

DETAILED DESCRIPTION OF THE DISCLOSURE

Although the invention will be described in terms of certain embodiments, other embodiments, including embodiments that do not provide all of the benefits and features set forth herein, are also within the scope of this disclosure. Various structural, logical, and process step changes may be made without departing from the scope of the invention.

Figure 1:
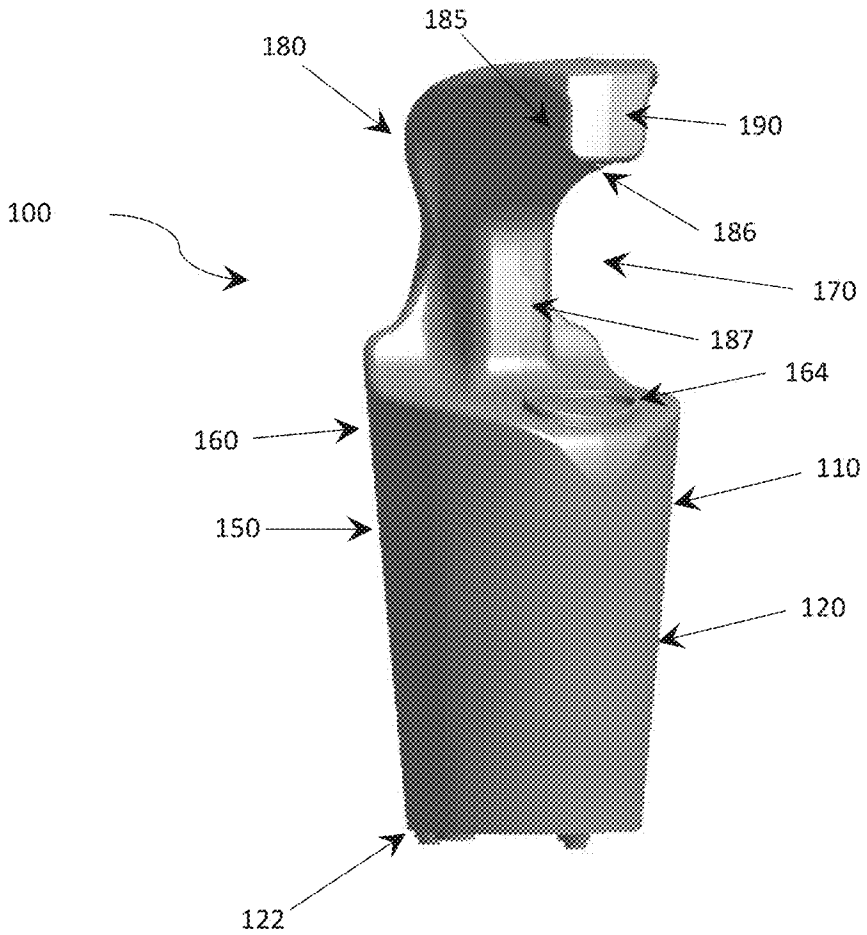
FIG. 1 shows a perspective view of a hand sanitizer dispensing device.

FIG. 1 shows an embodiment of a hand sanitizer dispensing device 100. The device 100 may be located in a cup holder in a vehicle, on the rear side of a seat in a vehicle, on the left or right side of a seat in vehicle, on the rear side of a headrest in a vehicle, or on any substantially horizontal or substantially vertical surface including surfaces within vehicles and surfaces outside of vehicles, including without limitation countertops and walls.

Figure 3:
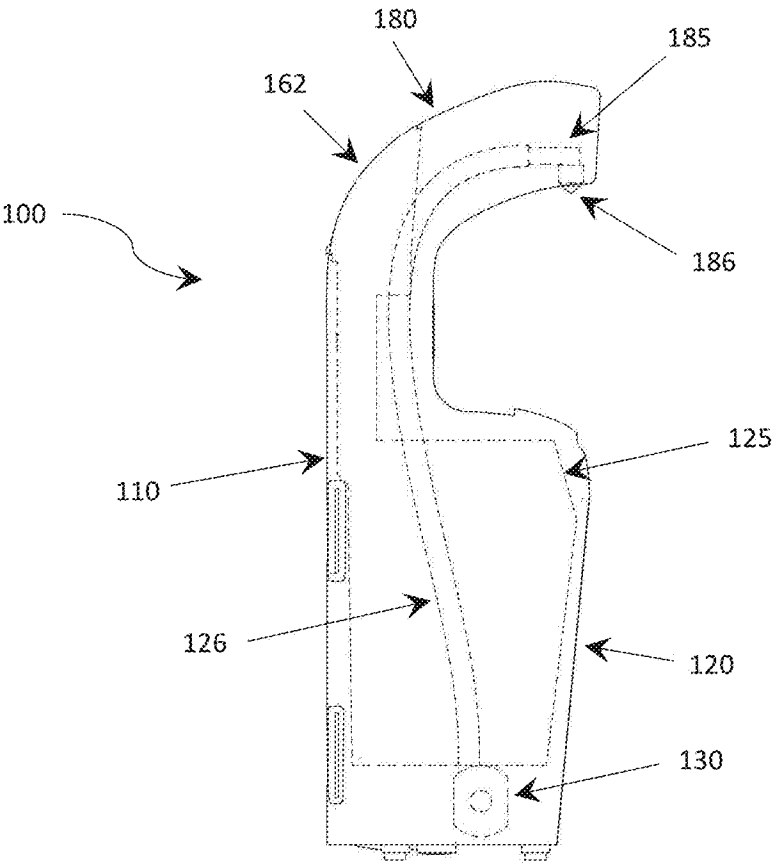
FIG. 3 shows a simplified left side view of the dispensing device of FIG. 2 with certain internal components shown with dashed lines.

Referring to FIG. 1, the device 100 comprises a housing 110. The housing 110 has a lower portion 120 and an upper portion 160. The upper portion 160 further comprises a spout section 180. As discussed further below and as shown in FIG. 3: The housing 110 contains a reservoir 125 for holding hand sanitizer. The spout section 180 contains a valve 185 having a valve outlet 186 through which hand sanitizer is dispensed to a user. A pump 130 operates to deliver hand sanitizer through a tube 126 from the reservoir 125 to and through the valve 185.

The lower portion 120 is configured to rest or fit stably in a cup holder in a vehicle. As shown in FIGS. 2*a*-2*f*, the bottom 122 of lower portion 120 is round or substantially round, like the bottom of a cup or mug. The sizes and shapes of cup holders in vehicles can vary, with some being larger and some being smaller in diameter or dimension. Most cup holders are round in shape and some are square or slightly rectangular. The diameter of the bottom 122 of the housing 110 can be sized to fit any such cup holders. In one embodiment, the diameter of the bottom 122 is approximately 65 millimeters (2 9/16 inches) or within the range of approximately 60 to 70 millimeters (2-3/8 to 2 3/4 inches), which the inventors have found to fit into most cup holders in vehicles. In another embodiment, the diameter of the bottom 122 is approximately 76 millimeters (3 inches) or within the range of approximately 70 to 83 millimeters (2-3/4 to 3 1/4 inches), which the inventors have found to fit in many cup holders in vehicles. In yet another embodiment the diameter of the bottom 122 is within the range of approximately 60 to 83 millimeters (2-3/8 to 3 1/4 inches).

The diameter of the lower portion 120 of the housing 110 can be the same or substantially the same as the diameter of the bottom 122 along the entire height of the lower portion 120. In such configuration, the lower portion 120 of the housing 110 is cylindrical or substantially cylindrical. Likewise, the diameter of the upper portion 160 of the housing 110 can be the same or substantially the same as the diameter of the bottom 120 along the some or all of the height of the upper portion 160. For example, the entire height of the upper portion 160 may be cylindrical up until the spout section 180, which spout section 180 may then be any other desired shape. In such configuration, the entire housing 110 other than the spout section 180 is cylindrical or substantially cylindrical.

Figure 2D:
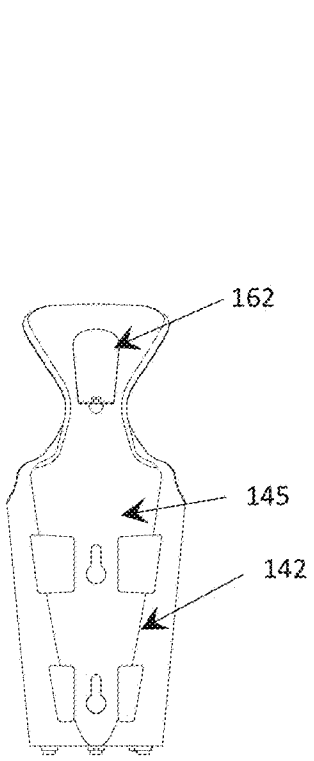
FIG. 2*d* shows a rear side view of the dispensing device of FIG. 1.
Figure 2C:
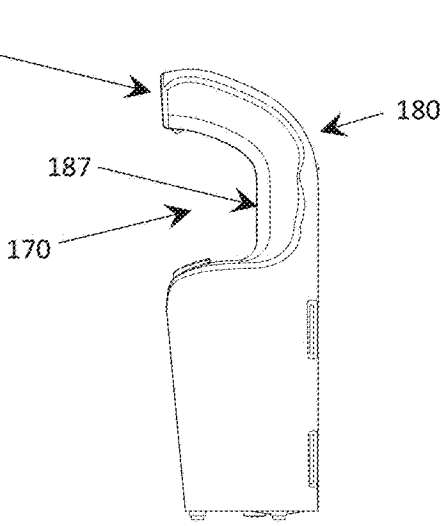
FIG. 2*c* shows a right side view of the dispensing device of FIG. 1.
Figure 2E:
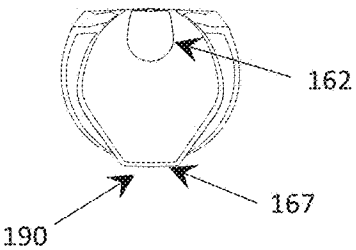
FIG. 2*e* shows a top side view of the dispensing device of FIG. 1.
Figure 2A:
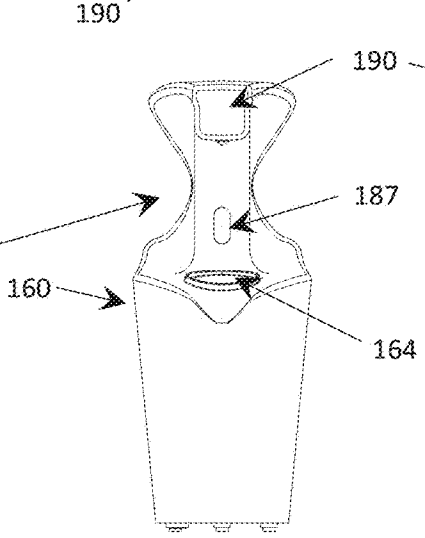
FIG. 2*a* shows a front side view of the dispensing device of FIG. 1.
Figure 2F:
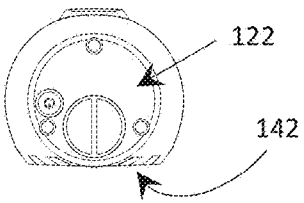
FIG. 2*f* shows a bottom side view of the dispensing device of FIG. 1.
Figure 2B:
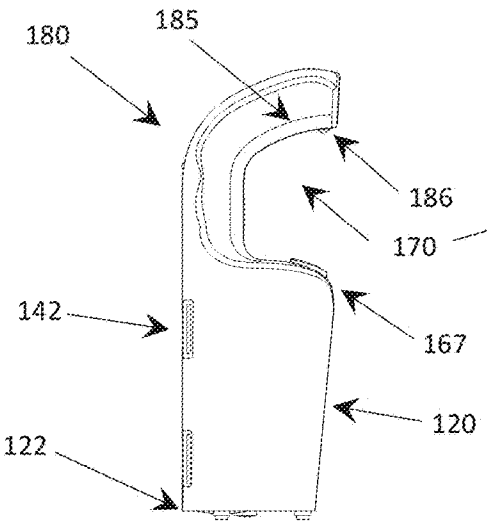
FIG. 2*b* shows a left side view of the dispensing device of FIG. 1.

Alternatively, as shown in FIGS. 2*a* and 2*d*, the lower portion 120 of the housing 110 can be tapered such that the diameter of the lower portion 120 increases upwardly along the height of the lower portion 120. The taper may be continued, i.e., the diameter may be increased, along the entire height of the lower portion 120 or only part way up the lower portion 120. Where the taper is continued along the entire height of the lower portion 120, the taper may continue, i.e., the diameter may continue to be increased, along some or all of the height of the upper portion 160 of the housing 110. For example, the taper may continue along the height of the upper portion up to but not including the spout section 180. In the embodiment of FIGS. 1 and 2*a*-2*f*, the taper is continued along the entire height of lower portion 120 and a portion of the height of upper portion 160 of the housing 110.

Many cup holders in vehicles are about 76 to 89 millimeters (3 to 3.5 inches) deep, though some are shallower and some are deeper. Whether the device 100 is tapered or non-tapered, the diameter of the device 100 at the point where the housing 110 coincides with the upper end of a cup holder, hereinafter referred to as the coincident height 150 (see FIG. 1), should be such that the housing 110 is at least slightly smaller than the size of the opening of the upper end of the cup holder. In the case of a square or rectangular cup holder, the diameter of the housing 110 at the coincident height 150 should be slightly smaller than the dimension of the shorter of the length and width of the opening of such cup holder. Some cup holders include flexible, compressible or otherwise movable elements near their upper ends for contributing to a snug fit with a cup or mug inserted therein, and in that case the diameter of the device 100 at the coincident height 150 should be such that the diameter is at least slightly smaller than the maximum diameter permitted by such movable elements when fully compressed or depressed. In one embodiment, the diameter of the device 100 at the coincident height 150 is approximately 81 millimeters (3 3/16 inches) or within the range approximately 76 to 86 millimeters (3 to 3 3/8 inches), which the inventors have found to fit into most cup holders in vehicles at the coincident height 150. In another embodiment, the diameter of the device 100 at the coincident height 150 is approximately 92 millimeters (3-5/8 inches) or within the range of approximately 86 to 98 millimeters (3-3/8 to 3 7/8 inches). In yet another embodiment the diameter of the device 100 at the coincident height 150 is within the range of approximately 76 to 98 millimeters (3 to 3 7/8 inches).

Where the housing 110 is tapered, the diameter of the housing from the bottom 122 to the coincident height 150 may graduate by any desired amount. In one embodiment, the diameter graduates by 16 millimeters (5/8 inches). In one example of such an embodiment, the bottom 122 has a diameter of 65 millimeters (2-9/16) and the diameter of the housing 110 at coincident height 150 is 81 millimeters (3 3/16 inches).

As discussed above, the housing 110 can be cylindrical or substantially cylindrical in shape along some or all of its height, or, as shown in FIGS. 1 and 2*a*-2*f*, it can be tapered or substantially tapered along some or all of its height. In one example, the device has a round bottom 122 and is tapered up until the coincident height 150 and then has a constant diameter along the remainder of some or all of the height of the housing 110. In another example, the device has a round bottom 122 and is tapered to a height beyond the coincident height 150 and then has a constant diameter along the remainder of some or all of the height of the housing 110. In a further example, the device has a round bottom 122 and is tapered along the entire height or substantially entire height of the housing 110. In any of such embodiments, all or a portion of one side 142 of the housing 110 may comprise a surface 145 that is flat or substantially flat, as shown in FIG. 2*d*. In the embodiment of FIG. 2*d*, side 142 is the rear side of the housing 110. Such flat or substantially flat surface 145 shall also be referred to herein as the "flat panel 145" or, where the flat surface 145 is at the rear side of the housing 110, it may alternatively be referred to as the "flat back 145".

Figure 5:
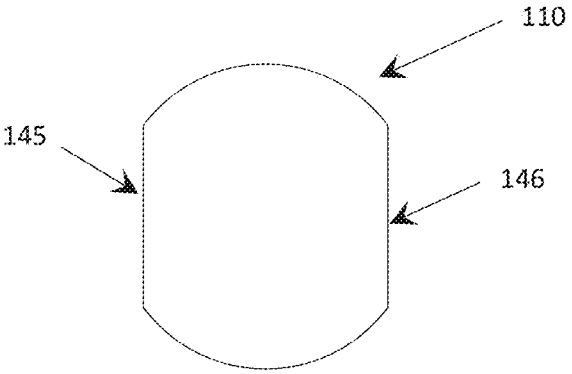
FIG. 5 shows a double D-shaped cross-section of a housing of a hand sanitizer dispensing device.
Figure 4:
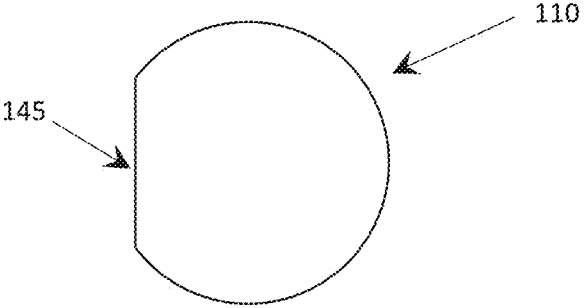
FIG. 4 shows a D-shaped cross-section of a housing of a hand sanitizer dispensing device.

In an embodiment where the housing 110 is generally cylindrical but has a flat panel 145, the housing has essentially a D-shaped cross-sectional geometry, as shown in FIG. 4. In another embodiment the housing 110 may be generally cylindrical with a flat panel 145 and also have an opposing side surface 146 that is flat, having a cross-sectional geometry as shown in FIG. 5. In the embodiment of FIG. 5, two opposing sides of all or a portion of the housing 110 are round or substantially round while the other two opposing sides are flat or substantially flat. The cross-sectional geometry of the housing 110 shown in FIG. 5 is herein referred to as a double D-shaped geometry.

In all of the embodiments described above, a portion of the housing 110 has one or more round or substantially round side surfaces and a portion of the housing 110 has one or more flat or substantially flat side surfaces, at least one of which is a flat panel 145 or flat back 145. In some of the embodiments described above, the shape of the housing 110 is tapered along all or a portion of the height thereof. The purpose of the round side surfaces, and additionally of the tapered shape of the housing if used, is to help provide that the device 100 fits into, and rests snugly or at least stably, within a vehicle's cup holder. The purpose of the flat panel 145 is to facilitate locating the device 100 in a stable way against the rear or side of a vehicle's seat or headrest, or against a wall or other vertical or substantially vertical surface. The embodiments of the device 100 described herein are thus sized and configured to use the device stably in two different locations, one location being a vehicle's cup holder and the other location being the rear side, or left or right side, of a vehicle's seat or headrest. At the same time, the device 100 in such sizes and configurations may be rested upon any flat or substantially flat surface and located against or mounted on any vertical or substantially vertical surface. Where the device is located against or mounted on a vertical or substantially vertical service, having one or more flat or substantially flat side surfaces also contributes to minimizing or reducing the degree to which the device projects outward from the vertical surface. This can be useful particularly in a vehicle where space is more limited.

Figure 7:
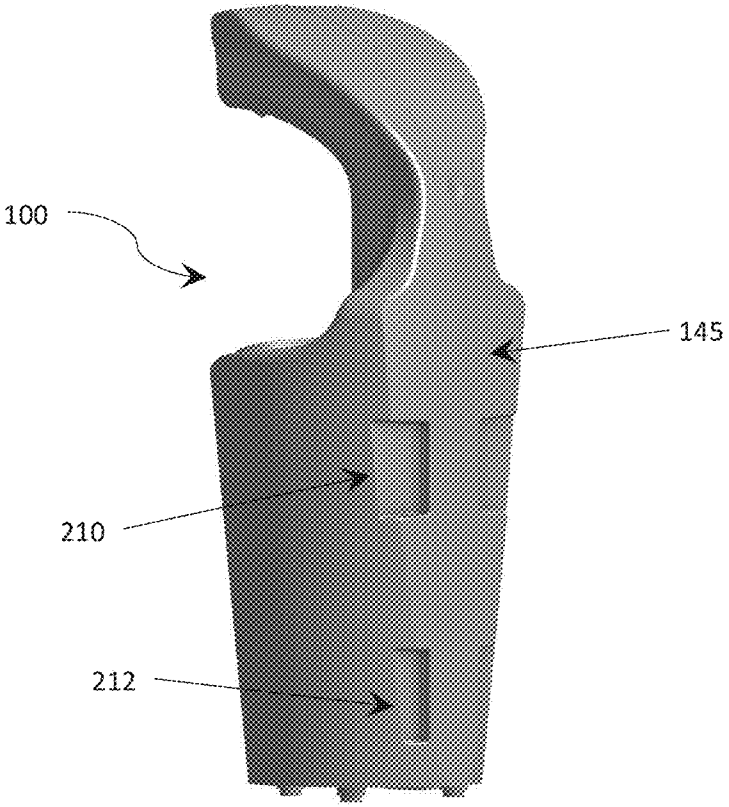
FIG. 7 shows a perspective view of a hand sanitizer dispensing device having slot mounting elements.

Referring to FIG. 7, to facilitate location of the device 100 against the back or side of a vehicle seat, headrest or other vertical or substantially vertical surface, the device 100 includes one or more mounting elements 210, 212, hereinafter first mounting element 210 and second mounting element 212. As shown in FIG. 7, the mounting elements 210, 212 are associated with the flat panel 145 of the housing 110. Each of mounting elements 210, 212 includes a slot or channel configured to receive a strap (not shown in FIG. 7) that can be extended around a vehicle seat or headrest, including the posts of a headrest, to fasten the device 100 against the back or side of the seat or headrest. In one embodiment, the device includes only one first mounting element 210 and a single strap is used to mount the device. In another embodiment, the device includes both the first mounting element 210 and the second mounting element 212 and two straps are used to mount the device.

Figure 6:
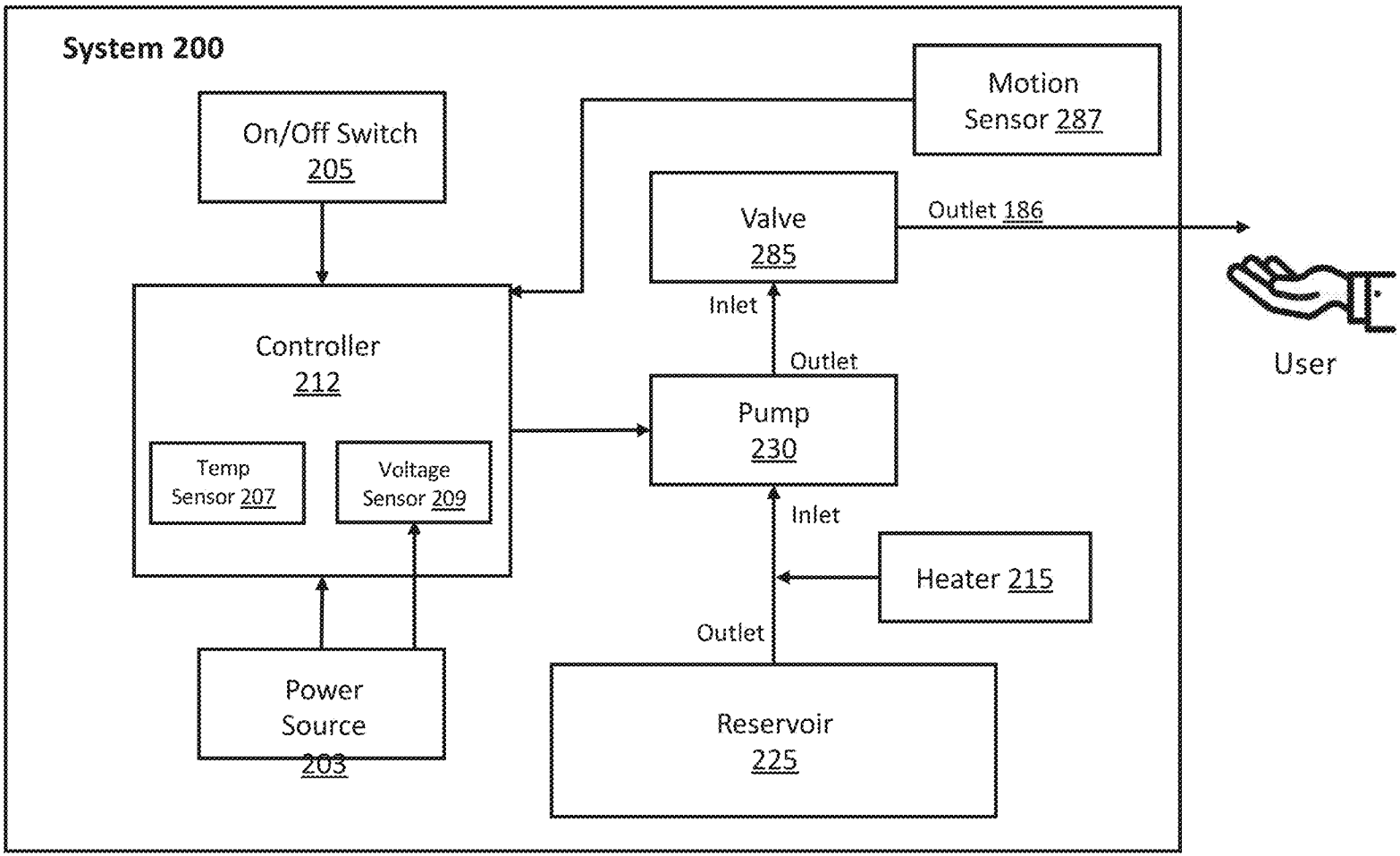
FIG. 6 is a diagram showing a system for dispensing hand sanitizer.
Figure 9B:
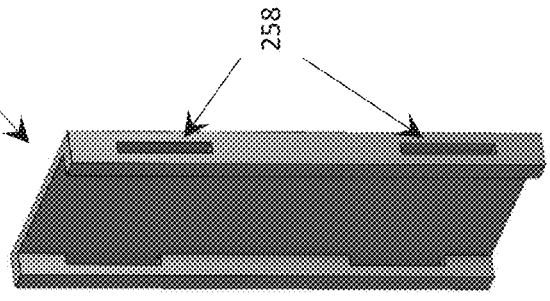
FIG. 9*b* shows a perspective view of an opposite side of the mounting bracket of FIG. 9*b*.
Figure 9A:
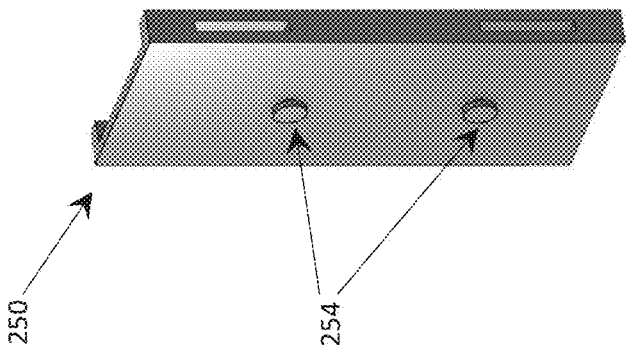
FIG. 9*a* shows a perspective view of a mounting bracket for use with the dispensing device of FIG. 8.
Figure 8:
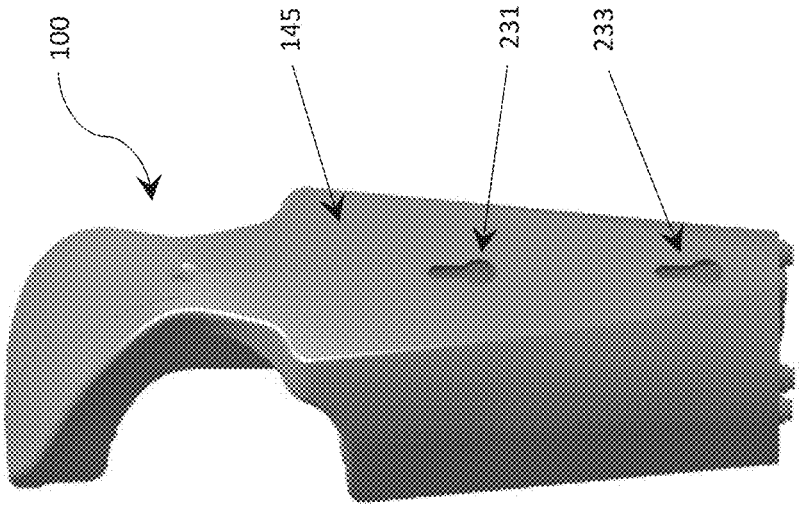
FIG. 8 shows a perspective view of a hand sanitizer dispensing device having keyhole mounting elements.
Figure 11B:
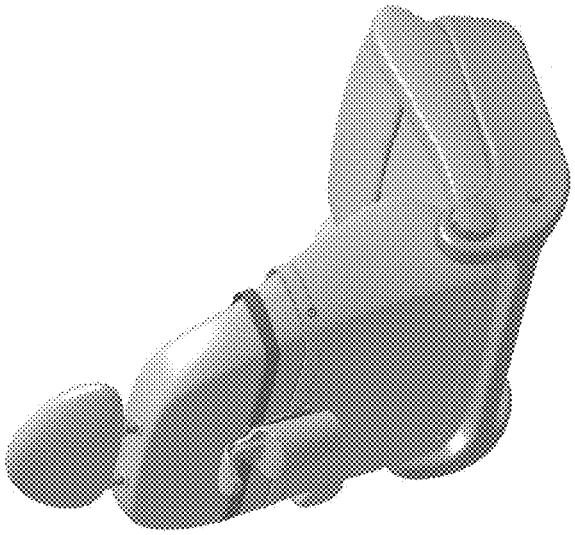
FIG. 11*b* shows a perspective view of the mounting bracket and straps of FIG. 10 secured to a vehicle seat and with a hand sanitizer dispensing device mounted on the mounting bracket.
Figure 11A:
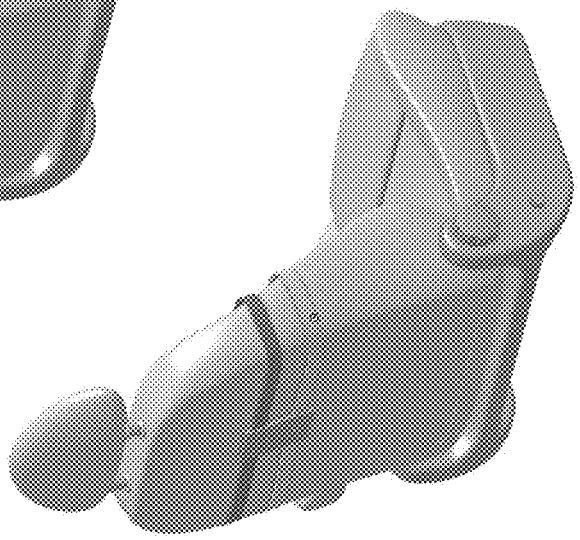
FIG. 11*a* shows a perspective view of the mounting bracket and straps of FIG. 10 secured to a vehicle seat.
Figure 10:
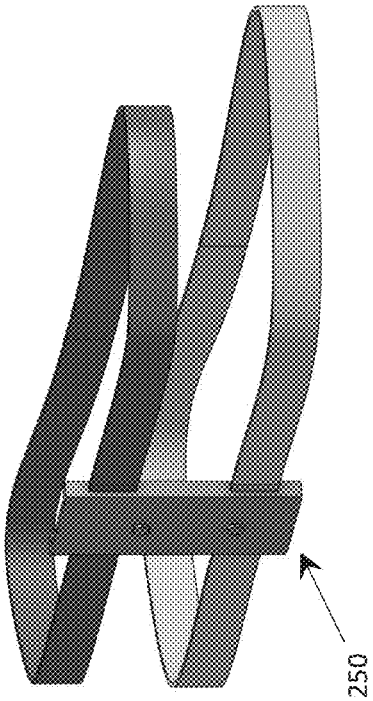
FIG. 10 shows a perspective view of the mounting bracket of FIGS. 9*a* and 9*b* with straps.

While the mounting elements 210, 212 are shown in FIG. 6 as channels and are used with straps, any suitable mounting elements, number of elements, and methods could be used. For example, as shown in FIGS. 8 and 9, an alternative embodiment of the device 100 includes one or more mounting elements 231, 233. Mounting elements 231, 233 are keyhole slots associated with the flat panel 145 of the housing 110. As shown in FIGS. 9*a* and 9*b*, a bracket 250 has studs 254 for mating with the keyhole mounting elements 231, 233. The bracket 250 further has slots or channels 258 configured to receive a strap that can be extended around a vehicle seat or headrest, including the posts of a headrest, to secure the bracket 250, and thus the device 100 when mounted on the bracket 250, against the back or side of the seat or headrest. FIG. 10 illustrates the mounting bracket 250 with straps threaded through the slots 258. FIGS. 11*a* and 11*b* illustrate the mounting bracket 250 secured to the rear side of a vehicle seat and the device 100 mounted to the mounting bracket 250, respectively. In one embodiment the device 100 includes only one of the mounting elements 231, 233 and another embodiment the device 100 includes both mounting elements 231, 233, and in each embodiment the bracket 250 is configured accordingly. One advantage of using a keyhole style mounting method is that the device 100 can be easily removed from and re-attached to the bracket 250 without removing the bracket 250 from wherever it is secured, such as a car seat or headrest.

In another example, as shown in FIGS. 2*c* and 2*d*, the device 100 can include multiple types of mounting elements. In this embodiment, the device 100 includes mounting elements that are slots/channels and mounting elements that are keyholes. The advantage of this arrangement is that the device 100 can be mounted to the rear or side of a vehicle seat or headrest either by (1) using straps threaded directly through the device 100, as described above with respect to FIG. 7, or (2) by mounting the device 100 to a bracket and using straps threaded directly through the bracket, as described above with respect to FIGS. 8 and 9.

Figure 12B:
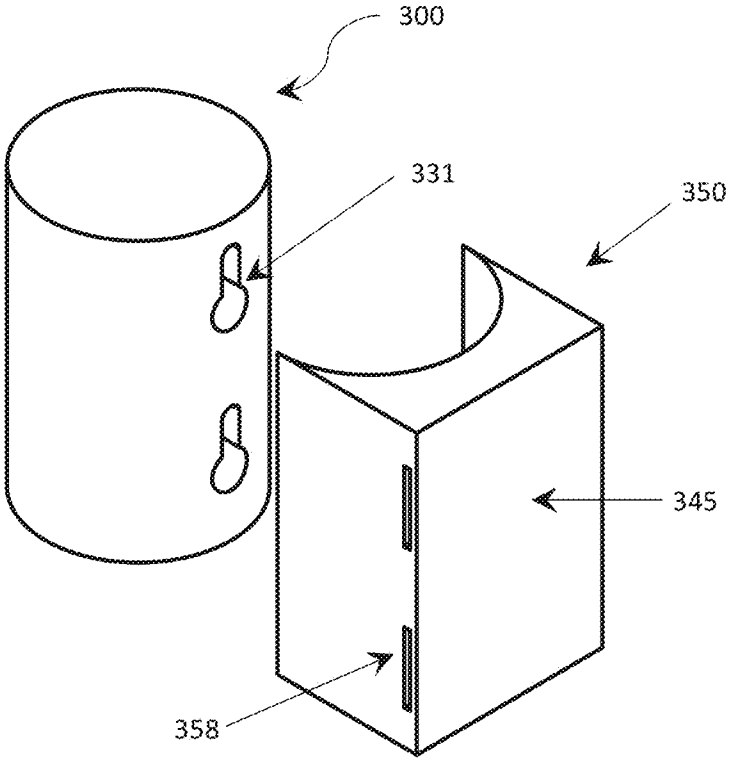
FIG. 12*b* shows a different perspective view of the hand sanitizer dispensing device and mounting bracket of FIG. 12*a*.
Figure 12A:
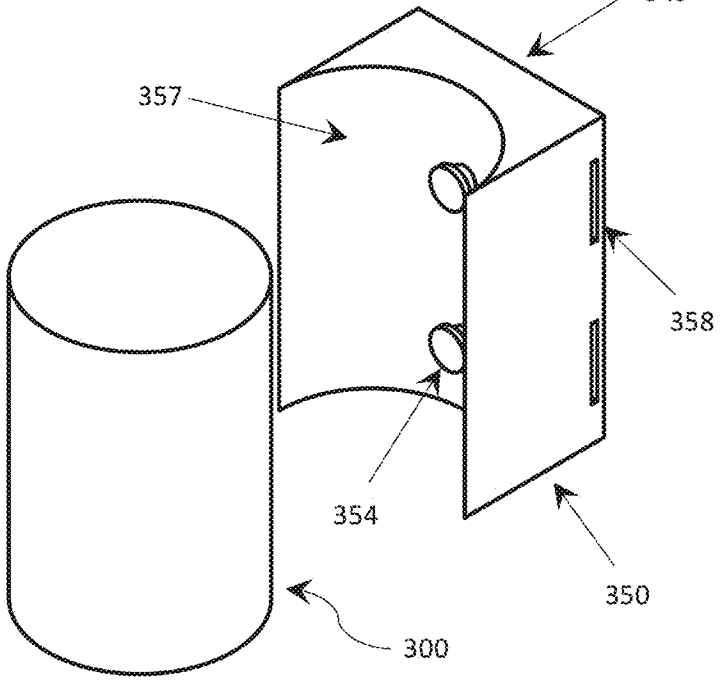
FIG. 12*a* shows a perspective view of another embodiment of a hand sanitizer dispensing device and mounting bracket.

To obtain some of the advantages of the above-described embodiments having at least one flat panel 145, alternative embodiments where the housing 100 does not have a flat panel 145 may be used. As shown in FIGS. 12*a* and 12*b*, such embodiments consist of a device 300 without a flat panel, i.e., that has only round surfaces, combined with a mounting fixture 350 that has a flat surface 345 for resting against a vertical or substantially vertical surface. The mounting fixture 350 has one or more mounting elements 358 for securing the mounting fixture 350 to a vehicle seat, headrest or other vertical or substantially vertical surface using one or more straps in the same manner or similar manner as described above in relation to FIGS. 9*a* and 9*b*. Meanwhile, the device 300 mounts onto the mounting fixture 350 by any suitable means, including without limitation by using keyhole slots 331 and studs 354. As shown in FIGS. 12*a* and 12*b*, the keyhole slots 331 are formed integrally in an outer surface of the device 300 and the studs 354 are provided on the mounting fixture 350 for mating the device 300 with the mounting fixture 350. Alternatively, the elements can be reversed, with the keyhole slots 331 formed integrally in the mounting fixture 350 and the studs 354 provided on the device 300. Any suitable manner of mounting the device 300 to the mounting fixture 350 can be used. As one example, not meant to be limiting, one or more magnets are used to mount the device 300 onto the mounting fixture 350. In such embodiment, the magnet may be attached to the mounting fixture 350 and a mating magnetic steel element attached to the device 300, or vice versa.

Figure 13:
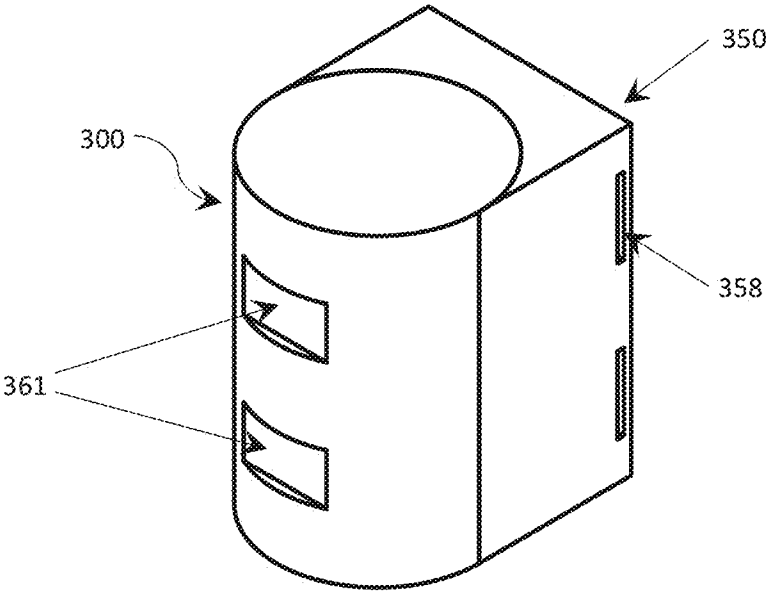
FIG. 13 shows a perspective view of a further embodiment of a hand sanitizer dispensing device and mounting bracket.
Figure 15:
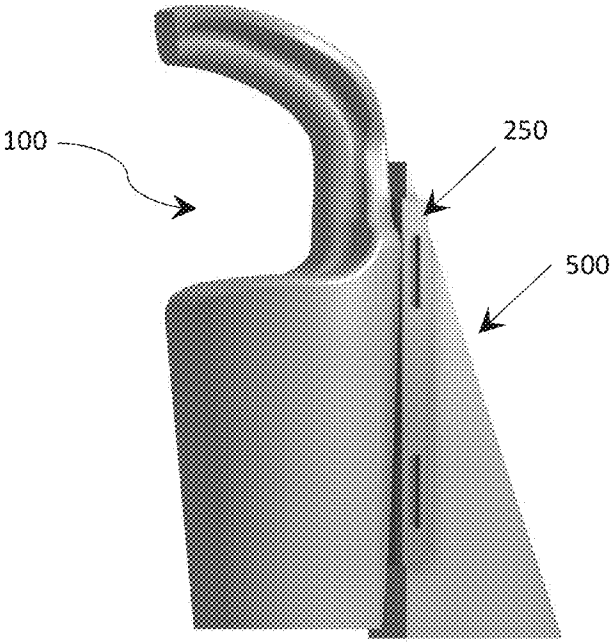
FIG. 15 shows a perspective view of a hand sanitizer dispensing device and a mounting bracket and further showing a wedge-shaped element for use in connection with securing the device and bracket to a vehicle seat.

Alternatively, rather than including mounting elements for securing the device 300 directly to a bracket 350, a strap can be placed around the outside of the device 300 when placed into the bracket 350 where the strap stays in place and secures the device 300 to the rear or side of a vehicle seat or headrest through pressure exerted from the strap. As shown in FIG. 13, this may be facilitated by providing one or more depressions 361 in the outer surface of the device 300 for helping to keep the straps in place against the device 300. Alternatively, rather than providing depressions in the surface of the device 300, ridges can be formed at the surface of the device projecting outward to define spaces similar to the depressions for receiving the straps. In either version of this embodiment, straps can be used either only around the outside of the device 300 to secure both the device 300 and the mounting bracket 350 to the rear or side of a vehicle seat or headrest, or straps can additionally be placed through one or more of the mounting elements 358 of mounting bracket 350 to further secure the bracket 350 to the vehicle seat or headrest. When straps are used only around the outside of the device 350, it is not necessary to include the mounting elements 358 in the mounting bracket 350.

In the embodiments of FIGS. 12-13, the device 300 is shown as having a constant diameter in the region of the device associated with the mounting fixture 350. However, the same approaches for mounting the device 300 can be used where the device 300 has fully or partially tapered sides or other geometries.

Figure 14:
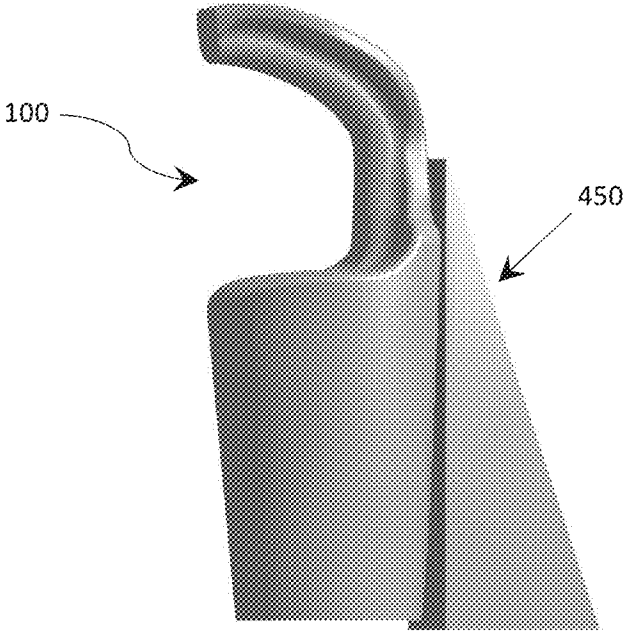
FIG. 14 shows a perspective view of a hand sanitizer dispensing device and another embodiment of a mounting bracket.

The backrest of front seats in vehicles are often declined to some angle, as shown in FIGS. 11*a* and 11*b*. Consequently, in the embodiments described above, when the device 100 or 300 is secured to the rear side of a vehicle seat, it may be in an orientation that is not perfectly vertical. As the angle of decline of a backrest increases, it may be desirable to provide a mounting bracket 450 that is wedge shaped, as shown in FIG. 14, to at least partially offset the angle of decline of the vehicle seat backrest. The wedge-shaped mounting bracket 450 helps to orient the device 100, 300 when secured on a declined rear side of a vehicle seat at a more substantially vertical or upright position. Alternatively, as shown in FIG. 14, to obtain a similar result, the mounting bracket 250 or 350 as shown in FIGS. 9 and 12 could be used and a wedge-shaped object or shim 500, similar in shape to the wedge-shaped mounting bracket 450, could be placed between the bracket 250, 350 and the rear side of the vehicle seat.

As mentioned above, and as shown in FIG. 1 and FIGS. 2*a*-2*d*, the upper portion 160 of the housing 110 includes a spout section 180 having a front edge 190. As further shown in FIG. 3, the spout section 180 contains a valve 185 having an outlet 186 through which hand sanitizer is dispensed to a user. The spout section 180 also contains a motion sensor 187 for detecting when a user's hand is under the valve 185 or the outlet 186 of the valve 185. As described further below, when a user's hand is detected, the motion sensor 187 sends a signal that activates the pump 130 to convey hand sanitizer through the value 185 to the user. The spout section, alone or together with other portions of upper portion 160 of the housing 110, or together with one or both of the upper and lower portions 160, 120 of the housing 110, defines an open area 170. Open area 170 is configured to be of sufficient size to permit a user's hand to be inserted below the motion sensor 187 and the outlet 186 of the valve 185 for receiving hand sanitizer from the outlet 186 and without needing to touch any surface of the device 100, including any surface of the housing 110, including any surface of the upper portion 160 or spout section 180. The opening may be any appropriate size. In one embodiment, the open area 170 has a height of approximately 70 millimeters (2.75 inches) and, as measured from the front edge 190 towards the rear of the upper portion 160 of the housing 110, a depth of approximately 51 millimeters (2 inches). In another embodiment, the open area 170 has a height within the range of approximately 44 to 95 millimeters (1.75 to 3.75 inches) and a depth in the range of approximately 25 to 76 millimeters (1 to 3 inches).

In the embodiment shown in FIG. 1 and FIGS. 2*a-f*, the spout section 180 has a front edge 190. The front edge 190 may be located so that it falls within the footprint of the front side of housing 110 directly below the spout section 180, or it may be located so that it extends beyond such footprint. In the embodiment of FIG. 1 and FIGS. 2*a-f*, the front edge 190 of the spout section 180 is located approximately coincident with the outermost reach of the front side of housing 110 directly below the spout section 180, also referred to herein as leading surface 167. In one embodiment, the leading surface 167 is a surface of the upper portion of the housing 110. One advantage of this embodiment is that it maximizes or increases the width of the open area 170, thus facilitating use of the device 100, while minimizing or reducing the footprint defined by the overall device 100. When the device 100 is located in a vehicle cupholder or on the rear of a vehicle seat or headrest, this configuration helps to reduce the device's interference with other structures in the vehicle, and also the space the device occupies in the cupholder area or otherwise in the vehicle. For example, many vehicles have more than one cup holder side-by-side between the driver and front passenger seats. By keeping the spout section 180 within or substantially within the lower footprint of the device 100, the device 100 when placed in one cupholder does not interfere with the driver's or passenger's ability to use the other cupholder for a cup, mug or other article. When the device 100 is placed on the rear of a vehicle seat or headrest, keeping the spout section 180 within or substantially within the lower footprint of the device 100 helps to minimizes or reduce the extent to which the device 100 projects into the rear passenger space and the possibility that a passenger getting into or out of the rear seat of the vehicle will bump into the device 100. Having a flat rear surface 142 further facilitates minimizing or reducing the extent to which the device 100 projects into the rear passenger space.

The outlet 186 of the valve 185 contained in the spout section 180 is set back from the front edge 190 of spout section 180 by a desired distance. Preferably, the valve outlet 186 is set back at a distance that is small enough so as to not compromise the space within open area 170 where a user can comfortably receive hand sanitizer without touching any surfaces of the device 100, but which is a sufficient distance from the front edge 190 of spout section 180 so that when hand sanitizer is dispensed, if it misses the user's hand, it will fall within the footprint of the housing 110 located below the valve outlet 186. This configuration helps to prevent hand sanitizer from dropping onto unintended areas around the device, such as for example a seat, floor or other surface of a vehicle. As shown in FIGS. 1 and 2*a-d*, the housing 110 may include a depression 164, also referred to herein as a trap 164, to catch sanitizer that misses a user's hand and prevent or minimize such caught sanitizer from spilling outward of the device 100. The trap 164 may be defined by the surfaces of the housing 110, or could be a separate component that is attached to the housing 110.

The motion sensor 187 has a field of view and range (distance) at which it detects movement. The field of view of motion sensor 187 is directed towards the open area 170 of the device 100 between the top end of the spout section 180 and a lower region of the upper portion 160 of the housing 110. The field of view of the motion sensor 187 can be directed at any desired angle. It is preferred to direct the field of view of the motion sensor 187 in a direction such that, in consideration of the motion sensor's range, it readily detects a user's hand when in position to receive hand sanitizer dispensed through valve outlet 186, yet also minimizes the detection of movement in the vicinity of the device that would dispense hand sanitizer either when not intended (a "false positive") or before the user's hand is in a proper position to receive hand sanitizer (a "premature activation").

As described above, the device 100 is touchless not only in that it employs a motion sensor for activating the device to dispense hand sanitizer, but also in that embodiments provide one or more features that improve both (1) the user's ability to activate the motion sensor and receive hand sanitizer without touching any surface, and (2) the dispensing of hand sanitizer in a manner that helps to provide that it falls into the user's hand and not onto unintended surfaces. These features include the size and configuration of the open area 170, the relative location of the front edge 190 of the spout section 180 to other portions of the housing 110 (and, in particular, providing that the front edge 190 does not extend beyond or substantially beyond the leading surface 167 of the housing), the location of the valve outlet 186 relative to the front edge 190, the location, line of sight and range of the motion sensor 187, and the trap 164.

As shown in FIGS. 2*d*, 2*e* and 3, the device 100 includes a refill port 162 through which the reservoir 125 can be refilled with hand sanitizer. In this embodiment, the refill port 162 is located towards the upper end of the upper portion 160 of housing 110. The refill port can be located in any desired position. An advantage of locating the refill port towards the upper end of the device 100 is that a user can refill the reservoir without turning the device over and without removing the device from its location of use, such as vehicle's cup holder or mounted on the rear or side of a vehicle seat or head rest.

System and Operation

FIG. 6 is diagram showing a system 200 for dispensing hand sanitizer. The embodiments 100 and 300 employ, incorporate or implement the system 200. The system 200 has a reservoir 225 for holding a volume of hand sanitizer and a valve 285 through which hand sanitizer is dispensed to a user. The system further has a pump 230, a power source 203, an on/off switch 205, a temperature sensor 207, a voltage sensor 209, a controller 212, a heater 215 and a motion sensor 287.

The pump 230 can be any suitable pump for pumping viscous and/or non-viscous hand sanitizer liquids, including without limitation a gear pump and a diaphragm pump. The valve 285 can be any suitable valve for dispensing viscous or non-viscous hand sanitizer liquids, including without limitation a cross slit valve, a duckbill valve or any other dispensing valve. The pump 230 is in fluid connection with the reservoir 225 through any suitable means, including without limitation plastic tubing or channels formed in interior portions of the housing 110, that connects an outlet of the reservoir 225 with an inlet of the pump 230. The pump 230 is also in fluid connection with the valve 285 through any suitable means, including without limitation plastic tubing or channels formed in interior portions of the housing 110, that connects the outlet of the pump 230 with an inlet of the valve 285.

The power source can be contained within the system 200, such as batteries including rechargeable batteries, or can be provided externally through a power cord, such as current supplied from a vehicle's battery. Rechargeable batteries if used can be recharged by connection to a vehicle's recharging power outlet using a suitable connection port on the device 100 and cabling. Any suitable power source can be used, including solar power. To that end, the device 100 can include a built-in or indirectly-connected solar panel. The controller 212 contains logic for operating the device and can be any suitable controller, including a printed circuit board. In FIG. 6, the temperature sensor 207 and the voltage sensor 209 are shown as being included as components of the controller 212. Alternatively, the sensors 207, 209 can be external components in electronic communication with the controller 212.

The pump 230 can be configured to deliver a predefined volume of hand sanitizer (hereinafter a "dose") to the valve 285, and thus to the user, each time the pump 230 is activated. The predefined dose volume may be, for example, 1 milliliter, but can be any desired volume. Alternatively, the system 200 can include a control (not shown) for a user to select a dose size from a pre-defined set of dose size options or to variably control the dose size. The dose size is controlled by the run time of the pump 230. The longer the pump runs, the more hand sanitizer it conveys to the valve and vice-versa. However, the volume of hand sanitizer that the pump 230 conveys over a given run time can vary as the temperature within which the system 200 is operating changes. First, changes in temperature can alter the viscosity of hand sanitizer liquid. Cold temperatures tend to increase viscosity causing the pump 230 to convey less fluid volume over a given amount of time. Warm temperatures tend to decrease viscosity causing the pump 230 to convey more fluid volume over a given amount of time. Second, changes in temperature, and particularly colder temperatures, can impact the voltage at which batteries operate. Battery voltage also drops as the battery drains. If the battery voltage drops, then the pump will run more slowly thereby reducing the volume of fluid conveyed over a given amount of time.

One use of the system 200 is within a vehicle. Temperatures within a vehicle, and particularly within parked, non-running vehicles, can vary greatly depending on the outside temperature in which the vehicle is located. In cold climates, temperatures within parked vehicles, or even outside of vehicles, can drop below freezing and well below −18° Celsius (0° Fahrenheit). In warmer climates or in summer months generally, temperatures within parked vehicles, or even outside of vehicles, can increase above 38° Celsius (100° Fahrenheit) and sometimes up to 65° Celsius (150° Fahrenheit) or more. The temperature sensor 207 of the system 200 is used to detect the temperature within the vehicle or wherever else the system 200 may be used. The controller 212 uses the temperature data to modulate the pump 230, i.e., to adjust the run time of the pump 230, to help provide that the desired dose size is delivered when the pump 230 is activated. At colder temperatures, the controller can cause the pump 230 to operate for longer run times, and in warmer temperature the controller can cause the pump 230 to operate for shorter run times.

Temperature within a vehicle or other locations can also impact the amount of voltage delivered by batteries in such locations. Additionally, when the remaining power within a battery diminishes, its voltage can drop. Where the power source includes batteries within the system 200, the voltage sensor 209 is used to detect the voltage at which the power source is operating. The controller 212 uses the voltage data to determine if voltage has dropped and, if so, to modulate the pump 230, i.e., to increase the run time of the pump 230, to help provide that the desired dose size is delivered when the pump 230 is activated.

As mentioned above, the system can include a heater 215. The heater is used to heat hand sanitizer to a desired temperature. This may be simply for user comfort, or may serve as an alternative to modulating the pump run time to provide relatively consistent dose size in colder temperatures. In the system 200 of FIG. 6, the heater 215 heats the hand sanitizer as it flows from the reservoir 225 to the pump 230, and preferably at or near the inlet of pump 230. However, the heater may be used at any location desired, including within the reservoir 225. An advantage of using the heater 215 at or near the pump inlet is that it will need to heat only the volume of hand sanitizer needed to deliver an intended dose size at the pump's given run time. In operation in one embodiment, the temperature sensor 207 is used to detect the ambient temperature near the hand sanitizer and the controller 212 uses the temperature data to turn on the heater 215 when the ambient temperature is below a desired temperature. In this embodiment, when the heater 215 reaches a desired temperature, it continues to run until the controller turns it off. The logic to turn of the heater 215 could be based on a temperature reading of the ambient temperature near the hand sanitizer, or by reading the temperature of the heater itself (using a second temperature sensor that measures the heater temperature), or by operating the heater for a pre-defined period of time. In another embodiment, the temperature sensor 207 is used to detect the temperature of the hand sanitizer directly and the control 212 uses the temperature data to turn on the heat 215 when the temperature of the hand sanitizer if below a desired temperature and then turn off the heater 215 when the temperature of the hand sanitizer reaches a desired temperature.

In operation, the system 200 can be located and used in a vehicle or elsewhere. The on/off switch 205 is used to turn the system 200 on and off. After the system 200 is turned on, the user places his or her hand within a line of sight of the motion sensor 287. The motion sensor 287 sends a signal to the controller 212, whereupon the controller activates the pump 230. The pump 230 operates to convey hand sanitizer from the reservoir 225 and to and through the valve 285, thereby delivering a dose of hand sanitizer to the user. If the temperature sensor 207 indicates a temperature that would cause the volume of hand sanitizer conveyed by the pump 230 to change from a desired amount for a given run time, then the controller instructs the pump 230 to run for a shorter or longer time as needed to achieve the desired dose size. Likewise, if the voltage sensor 209 indicates a voltage that would cause the volume of hand sanitizer conveyed by the pump 230 to drop from a desired amount for a given run time, then the controller instructs the pump 230 to run for a longer time as needed. Where a heater 215 is used, if the temperature sensor 207 indicates a colder temperature that would cause the volume of hand sanitizer conveyed by the pump 230 to drop from a desired amount for a given run time, or which would be discomforting to a user, then the controller 212 instructs the heater 215 to run until a desired temperature of the hand sanitizer or the air around the hand sanitizer is reached, whereupon the controller activates the pump 230. The controller 212 may then cause the heater to turn off or keep it running for as long a period as desired.

The devices 100 and 300 may use the same components and have the same method of operation as the system 200. The housing 110 of the device 100 (and of the device 300) can be made of any suitable material, including without limitation any suitable polymer or plastic such as nylon, ABS or other material. The housing 110, including the lower portion 120, the upper portion 160 and the spout section 180 can be made as a single unitary article or can be fabricated from two or more articles that are fastened together by any suitable means, including without limitation adhesive, screws, snap fits or other means. In one embodiment, the housing 110 is made of two articles comprising a clam shell having a left side and a right side that are snap fitted or glued together. The system components, such as the reservoir 125 or 225, controller 212, pump 130 or 230, valve 185 or 285, power source 203, heater 215, temperature sensor 207 and voltage sensor 209 are mounted or contained within the housing in any suitable configuration and by any suitable method. In one embodiment, the reservoir 125 or 225 is formed integrally with the housing 110. In another embodiment, the reservoir 125 or 225 is a separate article that is enclosed within the housing 110.

The devices and systems described herein may include additional features that improve the use and/or user experience of the device. The device may include an accelerometer to detect if the vehicle is moving and may use that information in a variety of ways. For example, if it is detected that the vehicle has not been moving for a predetermined amount of time implying that the vehicle is not in use, the device can turn itself off to reduce power consumption. In another example, if it is detected that the vehicle is experiencing significant changes in movement, such as hard stops or turns, the device could ignore any request for a dose (as triggered by the motion sensor) to avoid false positives or premature activations, or to help provide that a user does not fail to receive a does due to unsteadiness in the user's hand that might be caused by the vehicle motion. The device may include blue tooth, Wi-Fi, Near-Field Communication (NFC), cellular or other connectivity (including physical ports, e.g., a USB port) for the device to communicate with other devices, including without limitation smart phone applications and other devices and systems. In one example, a user can communicate with and control the device remotely to turn it on or off, specify a dose size, learn the temperature of the device or hand sanitizer, set an operating temperature, obtain information on the number of doses that have been dispensed, check the remaining battery life, check the level of hand sanitizer remaining in the reservoir, be alerted if the hand sanitizer reservoir is empty or near empty, and automatically order hand sanitizer refill. In support of such purposes, a sensor can be provided in the device to detect the level of hand sanitizer in the reservoir and to convey such information to the controller.

As shown in FIG. 1 and FIGS. 2*a-f*, the spout section 180 of housing 110 is shaped to resemble the head of a cobra snake. It is not necessary for the upper portion 140 to be shaped like a cobra head and, instead, any desired shape can be used.

While the devices, systems and methods are described herein for use with hand sanitizer, they can be used with any suitable fluid including, without limitation, soap.

It is intended that the foregoing detailed description be regarded as illustrative rather than limiting and that it is understood that the following claims including all equivalents are intended to define the scope of the invention.

What is claimed is:

1. A device for dispensing hand sanitizer configured for both locating in a vehicle cup holder and mounting against a vertical surface comprising:

a housing having two or more side surfaces, a lower portion including a bottom surface, an upper portion and a spout section;

wherein said bottom surface of said lower portion of the housing is round and said lower portion of the housing is sized to fit in the vehicle cup holder;

wherein said spout section is located above said upper portion of the housing and has an outlet for dispensing the hand sanitizer to a user and a front edge;

wherein said front edge defines a furthest extent to which the spout section extends outward from the housing;

wherein said outlet in the spout section for dispensing the hand sanitizer is a distance inward from the front edge of the spout section;

wherein said upper portion of said housing has a surface that defines a furthest extent to which the upper portion extends outward in a same direction as the front edge of the spout section, hereinafter a leading surface;

wherein the extent to which the front edge of the spout section extends outward from the housing is such that location of the outlet for dispensing the hand sanitizer is near to but does not exceed the extent to which the leading surface extends outward from the housing;

wherein at least one of the two or more side surfaces extends continuously along said lower and upper portions of the housing and said at least one of the two or more side surfaces is round; and wherein at least an other of the two or more side surfaces comprises a panel that is flat and extends continuously along said lower and upper portions of the housing.

2. The device of claim 1 wherein:

said housing is sized to fit in the vehicle cup holder at a coincident height of the cup holder.

3. The device of claim 2 further comprising:

a controller; and one or more of a temperature sensor, a voltage sensor, and an accelerometer.

4. The device of claim 1 further comprising:

a controller; and one or more of a temperature sensor, a voltage sensor, and an accelerometer.

5. The device of claim 4 further comprising a heater for directly or indirectly heating the hand sanitizer in the device.

* * * * *